US008907590B1

(12) United States Patent
LoCascio

(10) Patent No.: US 8,907,590 B1
(45) Date of Patent: Dec. 9, 2014

(54) SELF-ADJUSTED LED ILLUMINATION SYSTEM

(75) Inventor: James Jason LoCascio, Mountain View, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 376 days.

(21) Appl. No.: 13/480,239

(22) Filed: May 24, 2012

Related U.S. Application Data

(60) Provisional application No. 61/490,978, filed on May 27, 2011.

(51) Int. Cl.
*G05F 1/00* (2006.01)
*H05B 37/02* (2006.01)

(52) U.S. Cl.
USPC ..... 315/307; 315/291

(58) Field of Classification Search
CPC ..... H05B 37/02; H05B 41/16; H05B 41/24; Y02B 70/01; Y02B 20/22; H01J 65/04
USPC ..... 315/291, 307, 246, 247, 248
See application file for complete search history.

(56) References Cited

U.S. PATENT DOCUMENTS 7,573,209 B2 * 8/2009 Ashdown et al. ..... 315/307
7,965,151 B2 * 6/2011 Liu et al. ..... 332/109
8,018,171 B1 * 9/2011 Melanson et al. ..... 315/194

* cited by examiner

*Primary Examiner* — Minh D A
(74) *Attorney, Agent, or Firm* — North Weber & Baugh LLP

(57) ABSTRACT

Various embodiments of the present invention relate to a LED illumination system, and more particularly, to systems, devices and methods of employing a LED driver control loop to adjust the brightness of the LED light smoothly and suppress flickering/blinking. The LED driver control loop comprises a LED driver, a charge integrator, a VPWR modulator, and a driver controller. The charge integrator generates a voltage VC that is associated with a LED current $i_{LED}$ and illumination energy for the LED light. The VPWR modulator provides a clamping voltage VPWR such that the LED driver ceases to inject the LED current $i_{LED}$ as the voltage VC saturates at VPWR during each powering cycle. The clamping voltage VPWR is dynamically adjusted at the end of each powering cycle to gradually adjust the brightness and avoid flickering or blinking while still ensuring illumination efficiency.

20 Claims, 7 Drawing Sheets

SELF-ADJUSTED LED ILLUMINATION SYSTEM

CROSS REFERENCE TO RELATED APPLICATION

The application claims the benefit under 35 U.S.C. §119(e) of Provisional Application Ser. No. 61/490,978, entitled "A Self-Adjusted LED Illumination System", filed on May 27, 2011, the subject matter of which is incorporated herein by reference.

BACKGROUND

A. Technical Field

The present invention relates to a LED illumination system, and more particularly, to systems, devices and methods of employing a LED driver control loop for smooth brightness adjustment and flicker suppression.

B. Background of the Invention

Semiconductor-based solid-state lighting (SSL), until recently associated mainly with simple indicator lamps in electronics and toys, has become as bright and more efficient than other lighting technologies. In particular, the enormous technology improvements have been achieved on light emitting diodes (LEDs) over the past years. LEDs have been available for various wavelengths, and suitable for white illumination. Lifetime of LEDs is also extended to more than 100 thousand hours, and can work at input powers up to many watts.

LEDs are connected in series as a LED string for use in lighting applications. Each power LED in the LED string used for illumination requires a nominal current anywhere in the range of 35-1400 mA, a forward voltage drop of 3V and large manufacturing tolerances. The LED strings are typically powered by switched mode power supplies, and linear regulators are normally used to stabilize the LED output current for stable brightness.

FIG. 1 illustrates a standard LED illumination system 100, and FIG. 2 illustrates exemplary time diagrams of signals in a LED illumination system 100. The system 100 comprises a transformer 106, a full-wave rectifier (FWR) 108, and a LED light module 110. The transformer is coupled to an AC power source 102 at any wall outlet, and converts a high-voltage AC supply voltage VSUP down to a low-voltage AC supply voltage VT. The FWR 108 is further coupled to the transformer 106, and rectifies the voltage VT to a voltage VAC. The voltage VAC functions as a switched mode power supply for the LED light module 110. The voltage VAC is further regulated in the LED light module 110 to provide a stable LED drive current for illumination.

The transformer 106 may be a magnetic transformer or an electrical transformer. The magnetic transformer is a conventional approach that requires bulky magnets. The AC supply voltage VSUP from the wall outlet is normally a sinusoidal signal having an amplitude of 110V or 220V at 60 Hz (curve 202). The magnetic transformer reduces the amplitude to a lower magnitude, e.g. 12V, while maintaining the same frequency (curve 204) for the resulting supply voltage VT. However, the electrical transformer can largely reduce the magnet size by first generating a high-frequency signal at several MHz. The amplitude of this high-frequency signal is modulated by the AC supply voltage VSUP at 60 Hz. The electrical transformer subsequently reduces the amplitudes of the high-frequency voltage, and thus that of the corresponding envelope voltage (curve 208). The envelope voltage is extracted for output as VT which has a reduced amplitude (e.g., 12V) at 60 Hz. Regardless of the transformer type, the FWR 108 subsequently generates a half-wave voltage VAC (curves 206 or 212) corresponding to the voltage VT generated by the magnetic or electrical transformer. Each half wave pulse of VT is associated with a powering or illumination cycle for a LED light in the module 110.

When an electrical transformer is involved, it is apparent that two consecutive powering cycles are separated by a dead band in the AC power supply VAC (curve 212). In the dead band, the supply VAC is zero and provides no illumination power. This dead band is generated mainly due to an internal oscillator employed in the electrical transformer, and this internal oscillator starts at a voltage Vosc varying among powering cycles (curve 210).

The LED illumination system 100 may further comprises a dimmer 104 which is used to control the brightness of the LED light. The dimmer is placed between the AC power source 102 and the transformer 106. The brightness of the LED light is modulated by disabling current injection for a short period of time $t_{dim}$ during each powering cycle, and in particular, the dimmer is used to reset the voltage VSUP to zero during this period and unavoidably results in a dead band between two consecutive powering cycles.

Variation of the dead band width is often associated with a visual artifact issue. The supply VAC remains zero in the dead band, and therefore, the dead band is directly associated with illumination energy loss for the corresponding powering cycle. When the dead band width varies significantly during consecutive powering cycles, brightness of the LED light varies and directly causes visual artifacts, most commonly perceived as flickering or blinking by human eyes. In particular, a harmonic artifact shows up as flickering at 120 Hz for the 60 Hz dead bands. This visual artifact issue exists in a LED illumination system 100 involving the electrical transformer 106 and/or the dimmer 104, since the dead band width is normally not sufficiently controlled in such a system.

SUMMARY OF THE INVENTION

The present invention relates to a LED illumination system, and more particularly, to systems, devices and methods of employing a LED driver control loop to adjust the brightness of the LED light smoothly so that flickering/blinking are suppressed.

One aspect of the present invention is a LED driver control loop that comprises a LED driver, a charge integrator, a VPWR modulator, and a driver controller. The charge integrator generates a voltage VC that is associated with a LED current $i_{LED}$ and therefore illumination energy for the LED light. The VPWR modulator provides a clamping voltage VPWR such that the LED driver ceases to inject the LED current $i_{LED}$ as the voltage VC becomes equal to VPWR during a powering cycle. The clamping voltage VPWR is dynamically adjusted to gradually vary the brightness and avoid flickering or blinking while still ensuring illumination efficiency.

Another aspect of the present invention is a method of employing a feedback to smoothly adjust brightness of a LED light and suppress flickering/blinking. A control current $i_{con}$ is generated and associated with a LED current $i_{LED}$. The control current is further used to charge up a voltage VC within a powering cycle, and therefore, VC is associated with illumination energy with the cycle. When VC becomes equal to VPWR, the LED Driver is turned off thus causing $i_{LED}$ and $i_{con}$ to go to zero and resulting in no further increase of VC. As a result of VC equal to VPWR, the LED current $i_{LED}$ is set to zero and the voltage VC is clamped at a clamping voltage VPWR. Illumination energy per cycle is associated with VPWR that is gradually adjusted among consecutive powering cycles to avoid visual artifacts and maintain illumination efficiency.

Certain features and advantages of the present invention have been generally described in this summary section; however, additional features, advantages, and embodiments are presented herein or will be apparent to one of ordinary skill in the art in view of the drawings, specification, and claims hereof. Accordingly, it should be understood that the scope of the invention shall not be limited by the particular embodiments disclosed in this summary section.

BRIEF DESCRIPTION OF THE DRAWINGS

Reference will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments.

DETAILED DESCRIPTION OF THE PREFERRED EMBODIMENTS

Various embodiments of the present invention relates to a LED illumination system, and more particularly, to systems, devices and methods of employing a LED driver control loop to adjust the brightness of the LED light smoothly and suppress flickering/blinking are suppressed. It will be apparent, however, to one skilled in the art that the invention can be practiced without these details. One skilled in the art will recognize that embodiments of the present invention, described below, may be performed in a variety of ways and using a variety of means. Those skilled in the art will also recognize additional modifications, applications, and embodiments are within the scope thereof, as are additional fields in which the invention may provide utility. Accordingly, the embodiments described below are illustrative of specific embodiments of the invention and are meant to avoid obscuring the invention.

Reference in the specification to "one embodiment" or "an embodiment" means that a particular feature, structure, characteristic, or function described in connection with the embodiment is included in at least one embodiment of the invention. The appearance of the phrase "in one embodiment," "in an embodiment," or the like in various places in the specification are not necessarily all referring to the same embodiment.

Furthermore, connections between components or between method steps in the figures are not restricted to connections that are effected directly. Instead, connections illustrated in the figures between components or method steps may be modified or otherwise changed through the addition thereto of intermediary components or method steps, without departing from the teachings of the present invention.

Figure 1:
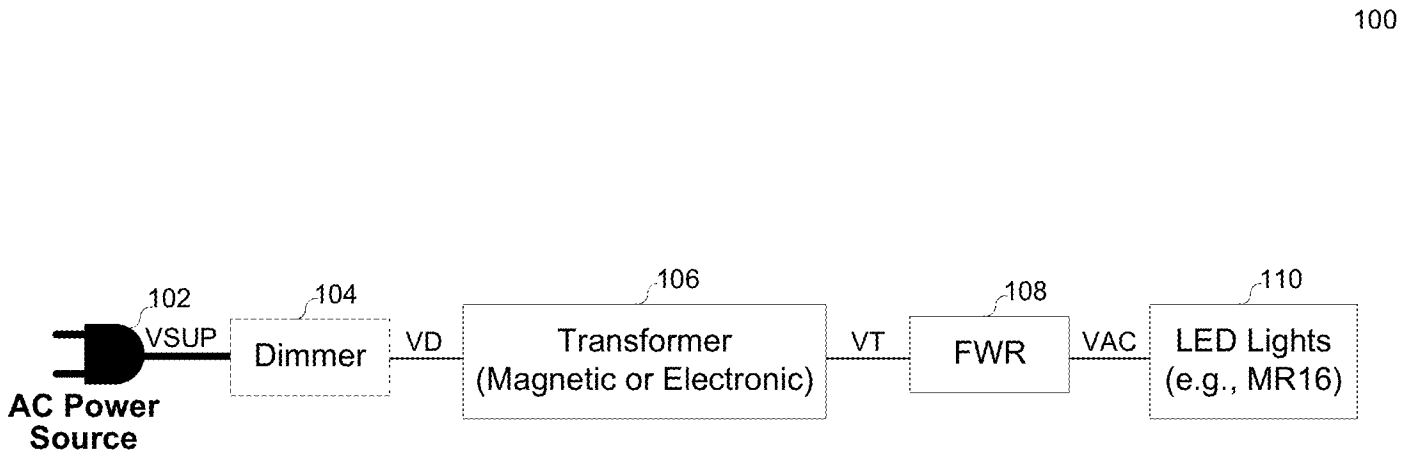
FIG. 1 (PRIOR ART)
FIG. 1 illustrates a standard LED illumination system.
Figure 2:
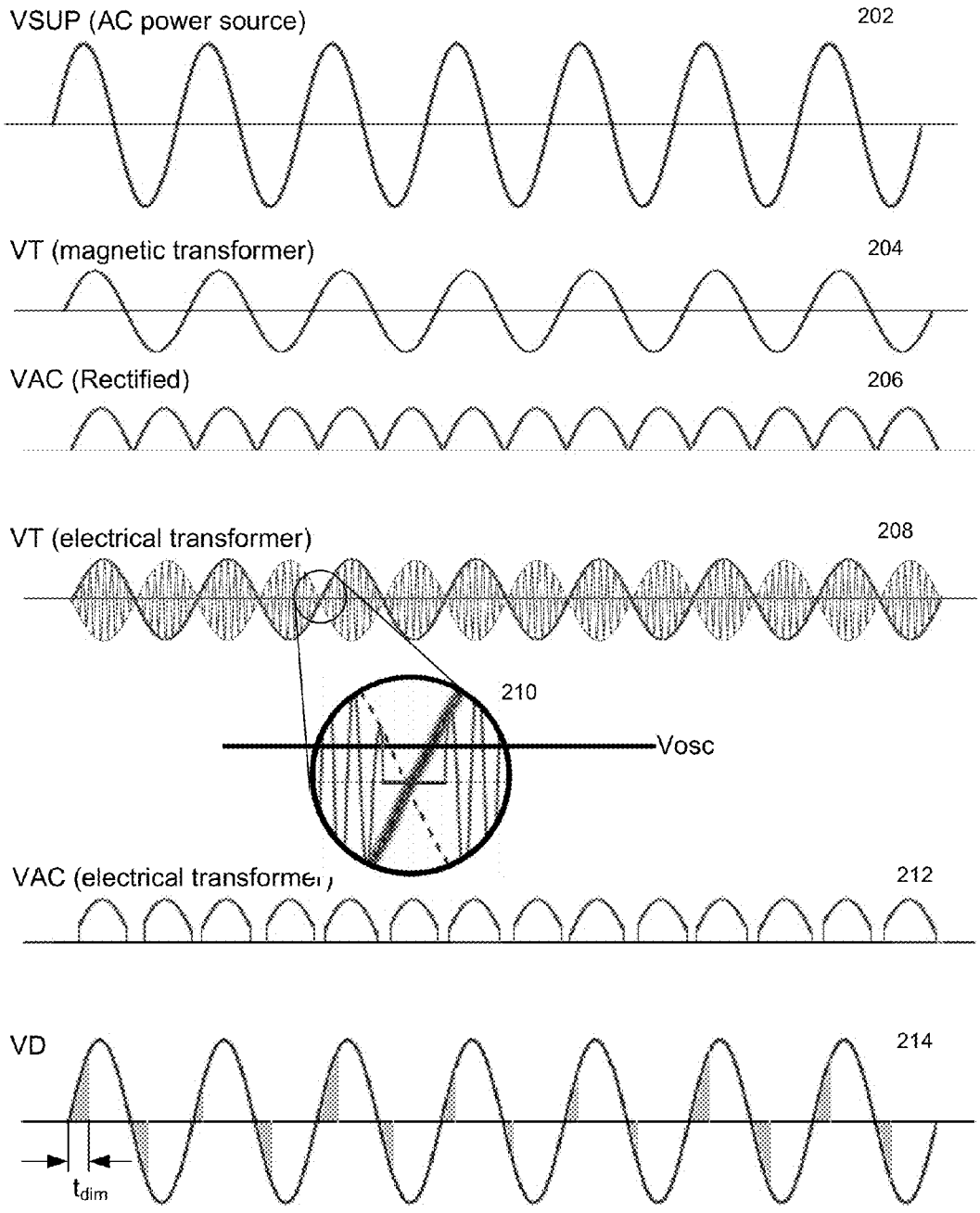
FIG. 2 illustrates exemplary time diagrams of signals in a LED illumination system.
Figure 3A:
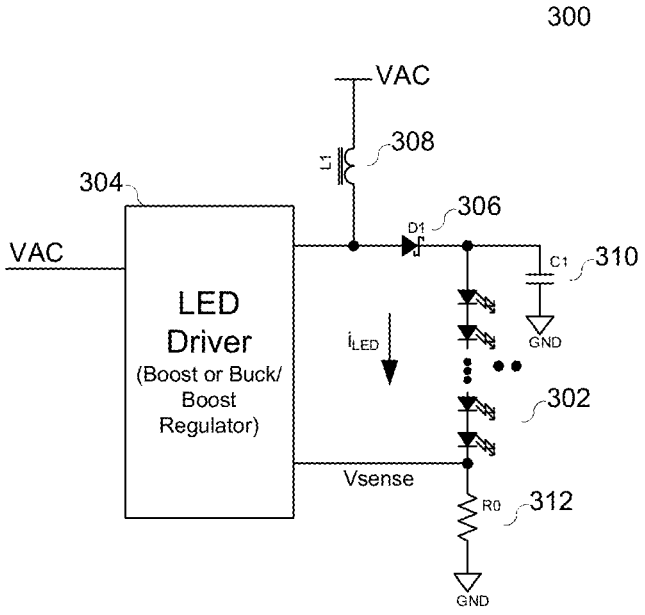
FIG. 3A illustrates an exemplary block diagram of a LED light module according to various embodiments of the invention.

FIG. 3A illustrates an exemplary block diagram of a LED light module 300 according to various embodiments of the invention. The LED light module 300 comprises a LED light string 302 driven by a LED driver 304, and a series of passive components including a diode D1 306, an inductor L1 308, a resistor C1 310, and a resistor R0 312. The switched mode supply VAC is a pulsed voltage containing dead bands between consecutive pulses/cycles, and the LED driver 304 and the passive components 306-310 regulates the supply VAC to generate a LED current $i_{LED}$. The LED driver 304 may be implemented as a standard buck, boost or buck-boost converter configuration. The resistor R0 312 is placed in series with the LED light string 302. Since R0 is grounded, the bias voltage Vsense on R0 may be used in the LED driver 304 to monitor the LED current $i_{LED}$. In various embodiments of the present invention, the LED light string 302 may comprise one LED or more than one LED.

The duty cycle of the LED current $i_{LED}$ has to hold stable among consecutive powering cycles in order to avoid flickering or blinking in LED lighting. In certain embodiments, the frequency associated with the powering cycles is about 120 Hz. Human eyes integrate the illumination power within each powering cycle. Although each individual dead band between adjacent powering cycles is not recognized, significant width variation of the dead bands may still lead to flickering at 60 Hz or blinking as seen by human eyes. In order to avoid this flickering/blinking issue, a LED driver control may be integrated into the LED light module 300 to receive a feedback about $i_{LED}$ from the bias voltage Vsense. Therefore, a LED driver control may be used to control the width of the dead bands by terminating the duty cycle of $i_{LED}$ prior to the irregular dead bands starts.

Figure 3B:
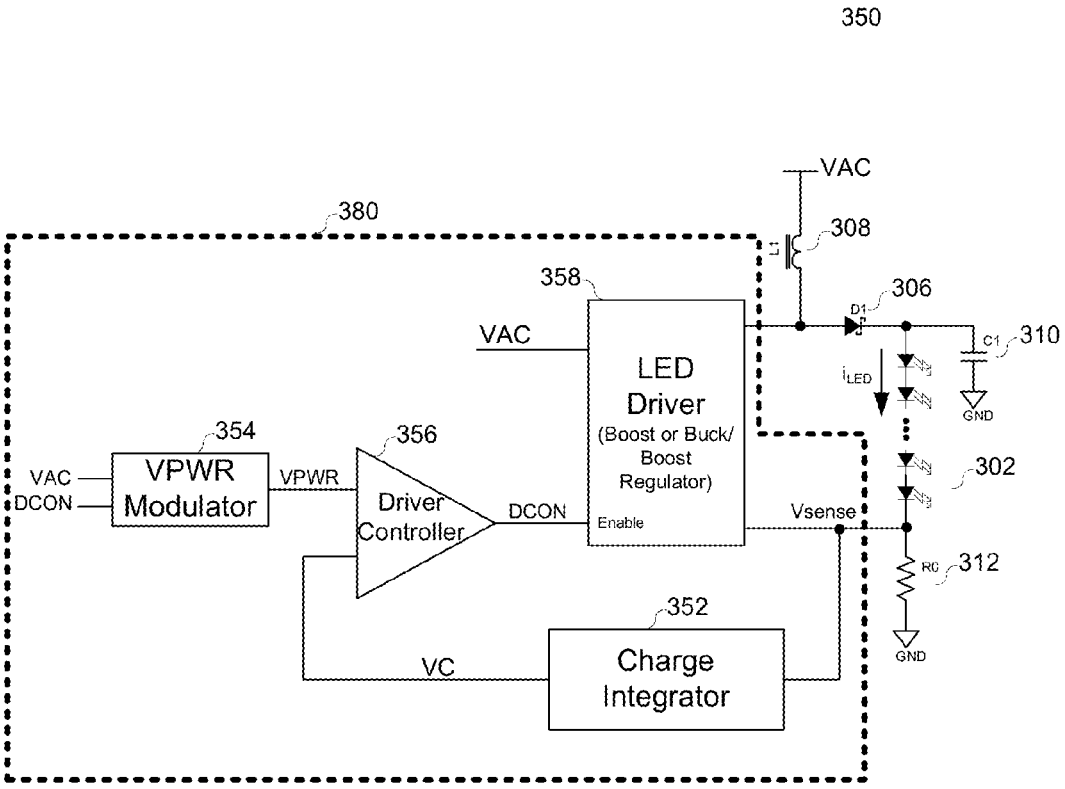
FIG. 3B illustrates an exemplary block diagram of a LED light module based on a LED driver control loop according to various embodiments of the invention.

FIG. 3B illustrates an exemplary block diagram of a LED light module 350 based on a LED driver control loop 380 according to various embodiments of the invention. The LED driver control loop 380 comprises a LED driver 358, a charge integrator 352, a VPWR modulator 354, and a driver controller 356. The charge integrator 352 is coupled to the LED driver 304 and the LED light string 302. The charge integrator 352 generates a voltage VC according to the bias voltage Vsense. In various embodiments of the present invention, this bias voltage Vsense is used to create a current $i_{con}$ that is proportional to Vsense and is injected to the capacitor inside the charge integrator 352. The voltage VC increases as more charges are injected from the current $i_{con}$. The driver controller 356 is coupled to the charge integrator 352, compares the voltage VC with a clamping voltage VPWR, and generates a driver control signal DCON. The VPWR modulator 354 is coupled to receive the switched mode supply VAC and the driver control signal DCON to adjust the magnitude of the clamping voltage VPWR at the end of each powering cycle. The LED driver 358 is coupled to the driver controller 356, and uses the driver control signal DCON to disable excessive delivery of the LED current $i_{LED}$ at the end of each powering cycle. Basically, such a LED driver loop 380 adjusts the duty cycle of illumination within each powering cycle according to the LED current $i_{LED}$, the supply VAC and the clamping voltage VPWR.

The voltage VC is generated from the current $i_{con}$ in the charge integrator 352, and is directly related to an integral of the current $i_{con}$. Since $i_{con}$ is associated with the voltage Vsense and thus the LED current $i_{LED}$, the voltage VC is also related to the integrals of the LED current $i_{LED}$. One of those skilled in the art knows that brightness of the LED can be quantitatively represented by illumination power delivered to the LED light string 302, and that the charge, i.e., integral of $i_{LED}$, may be used to indicate the level of this illumination power. As a result, the level of the voltage VC indicates the charge associated with $i_{LED}$, and may be used to monitor the brightness of the LED light string 302.

Figure 4:
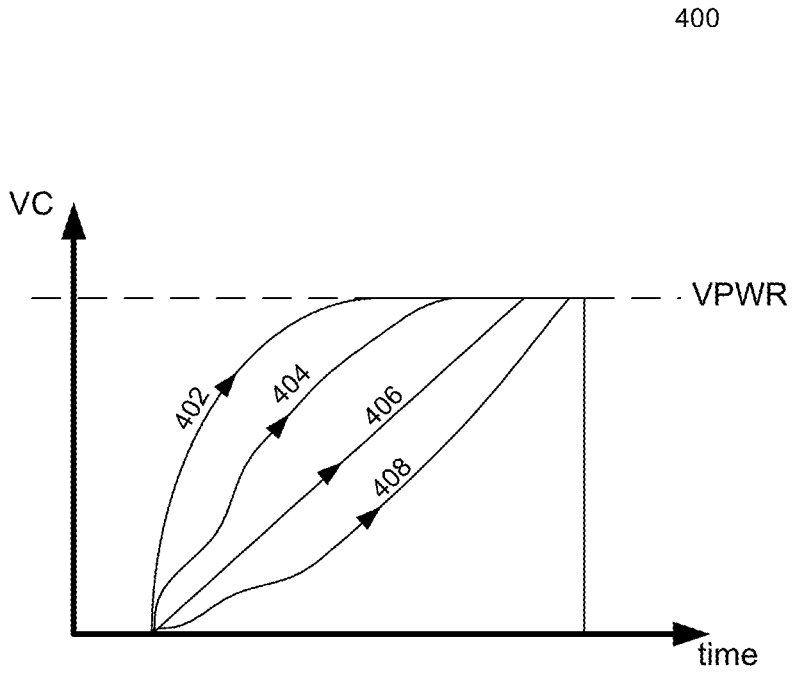
FIG. 4 illustrates an exemplary time diagram of a voltage VC following various charging paths to reach the voltage VPWR within a powering cycle according to various embodiments of the invention.

In various embodiments of the present invention, the voltage VC is clamped at a clamping voltage VPWR in order to gain a stable brightness level among consecutive powering cycles. FIG. 4 illustrates an exemplary time diagram of a voltage VC following various charging paths to reach the voltage VPWR within a powering cycle according to various embodiments of the invention. In curves 402, 404, 406 and 408, each voltage VC is charged up to the voltage VPWR along a respective path. Each path is associated with the supply VAC, the configurations of the LED driver 304 and the charge integrator 352. Regardless of the charging path, as far as the voltage VC terminates at a stable clamping voltage VPWR for various powering cycles, the charge injected into the LED string 302 remains stable, and so does the brightness of the LED light across these cycles.

The driver controller 356 is used to compare the voltage VC and the predetermined clamping voltage VPWR during each powering cycle. Once the voltage VC is equal to or larger than the voltage VPWR, the LED light has received sufficient energy for illumination within the corresponding powering cycle. The driver control signal DCON is set to zero such that the LED driver 304 is disabled from injecting more current into the LED light string 302 ($i_{LED}$=0 and Vsense=0). As a result, the current $i_{con}$ is diabled in the charge integrator 352, and the voltage VC remains at the clamping voltage VPWR awaiting to be reset for a subsequent powering cycle.

The variation of VPWR needs to be controlled within a low level among consecutive powering cycles to ensure stable brightness. Stable brightness is based on a brightness variation suppressed below a level that human eyes may resolve. When every other cycle of the 120 Hz waveform is different from the previous cycle, it results in a detectable variation at 60 Hz. At a frequency of 60 Hz, a resolvable brightness variation is about 1% of the nominal brightness, and a larger variation directly causes visual artifacts, i.e., flickering and blinking. Since the voltage VPWR is associated with the illumination energy (brightness) that the LED light string 302 delivers within a powering cycle, the variation of VPWR also needs to be controlled within 1% of a nominal value of VPWR among consecutive powering cycles to ensure stable brightness. In certain embodiments, the LED driver control loop 380 is powered by a supply at 3V, and the voltage VPWR may be approximately 2.5V. The variation of the voltage VPWR needs to be suppressed below 25 mV or less among consecutive powering cycles such that human eyes may not observe any flickering or blinking. In various embodiments of the present invention, appropriate levels of the clamping voltage VPWR and an allowable variation of VPWR may be determined by LED brightness ($i_{LED}$) and charging capacity of the charge integrator 352.

The clamping voltage VPWR is gradually adjusted by a variation voltage by the VPWR modulator 354 at the end of each powering cycle. The VPWR modulator 354 is coupled to receive the switched mode supply VAC and the driver control signal DCON. The supply VAC is used to determine the end of a powering cycle, and the signal DCON indicates whether illumination lasts the entire powering cycle. If illumination does not last to the end of the cycle, VPWR is increased by a first voltage Δvpwr1 such that more available energy can be utilized for illumination. If illumination lasts to the end of the cycle, VPWR is decreased by a second voltage Δvpwr2 such that the duty cycle of $i_{LED}$ may be reduced to avoid the drift of the cycle end from causing brightness variation. Both Δvpwr1 and Δvpwr2 are controlled within the allowable variation that is associated with brightness variation undetectable by human eyes.

In various embodiments of the present invention, the first and second voltages Δvpwr1 and Δvpwr2 are equal. In a preferred embodiment, Δvpwr1 is smaller than Δvpwr2, such that VPWR is adjusted down in a faster rate, when illumination energy is used up and the LED system is vulnerable to flickering. Therefore, the VPWR modulator 354 involves two variation voltages, corresponding to VPWR increase and decrease adjustments respectively.

Figure 5:
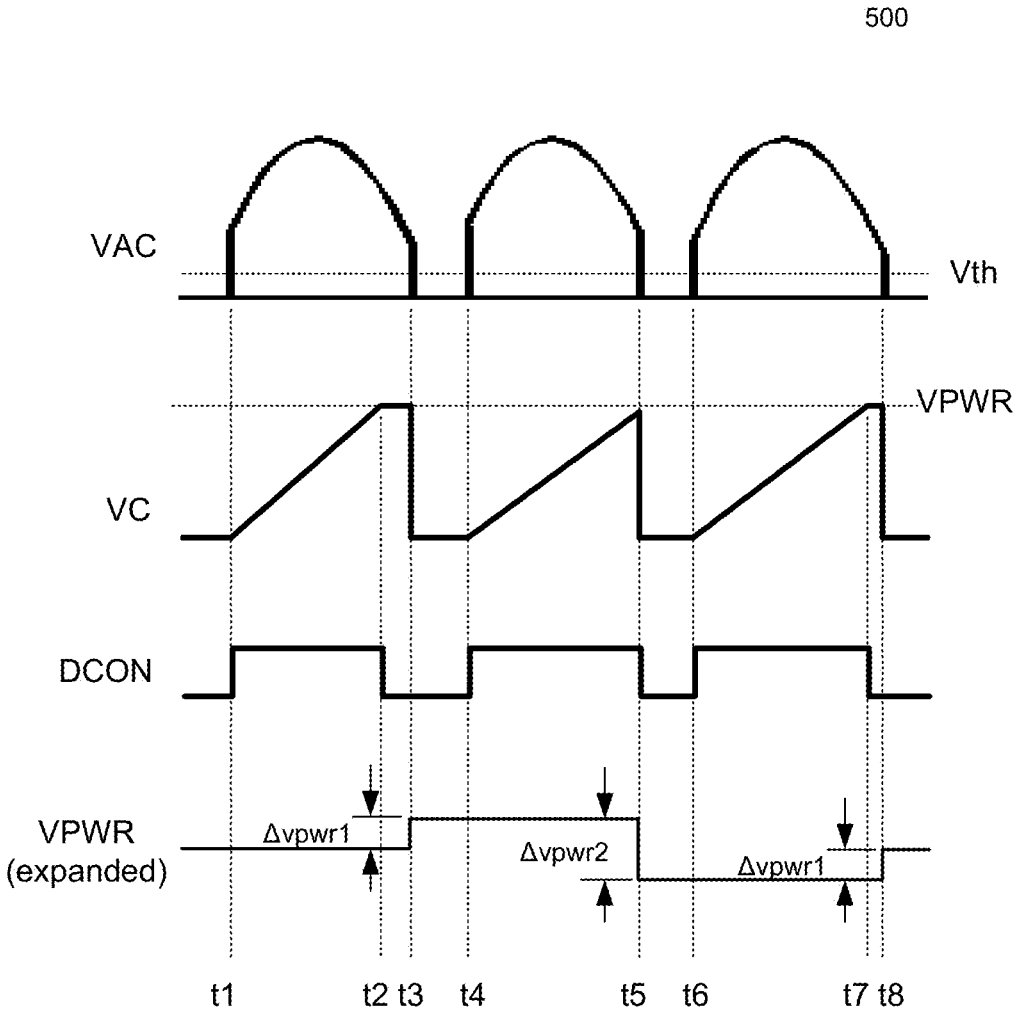
FIG. 5 illustrates exemplary time diagrams of signals (VAC, VPWR, VC and DCON) involved in a LED driver control loop according to various embodiments of the invention.

FIG. 5 illustrates exemplary time diagrams 500 of signals (VAC, VPWR, VC and DCON) involved in a LED driver control loop 380 according to various embodiments of the invention. The switched mode supply VAC is a pulsed signal involving dead bands (e.g., VAC=0) between consecutive power cycles. In one embodiment, the supply VAC peaks at 12V and has a frequency of 120 Hz. Times t1, t4 and t6 are associated with the zero cross points at rising edges of consecutive cycles, and may be identified when the supply VAC reaches a threshold voltage Vth. Similarly, times t3, t5 and t8 are identified as the zero cross points at falling edges of consecutive VAC pulses when VAC drops to Vth. In various embodiments, Vth is set at a low voltage level that is sufficiently higher than the noise level in the dead bands while lower than the supply VAC pulses.

The voltage VC is charged from zero at the zero cross points of the rising edges (times t1, t4 and t6), and reset to zero at the zero cross points of the falling edges (times t3, t5 and t8). In a first powering cycle, when the LED current $i_{LED}$ is sufficiently large, the associated voltage VC is charged up at a fast rate, and reaches the level of a clamping voltage VPWR at time t2 prior to termination of the VAC pulse. The voltage VC remains at VPWR until the falling edge of VAC is detected at time t3. In a second powering cycle, when the LED current $i_{LED}$ is slightly low, the voltage VC is charged up at a slower rate such that the voltage VC reaches a level slightly below VPOWR at time t5 when the VAC pulse terminates. In a third powering cycle, due to sufficient current injection, the voltage VC reaches the clamping voltage VPWR at time t7 prior to the termination of VAC pulse.

In accordance with the voltage VAC, the driver control signal DCON is enabled at zero cross points of the rising edges (times t1, t4 and t6). During the first and third powering cycles, sufficient LED current $i_{LED}$ may be provided to generate desirable brightness, and therefore, the signal DCON is set to zero at times t2 and t7, when sufficient illumination energy is reached, i.e., when VC reaches VPWR. During the second cycle, illumination energy is not sufficient, and the signal DCON is reset to zero at time t5 upon termination of the powering cycle. When DCON is at low, the LED driver 304 is disabled from injecting the LED current $i_{LED}$, and LED illumination ceases.

The clamping voltage VPWR is directly associated with the brightness of the LED illumination system, and it is adjusted for each powering cycle to gain maximum brightness while avoiding flickering and blinking. In the first powering cycle between times t1 and t4, the voltage VC reaches VPWR. Although more illumination energy may be still available, the LED current $i_{LED}$ is disabled. In order to better utilize illumination energy, VPWR is increased by a voltage Δvpwr1 when the cycle is terminated (time t3), such that the subsequent cycle may allow a higher brightness level. Since the voltage Δvpwr1 is small, the associated brightness variation is not resolvable by human eyes. One of those skilled in the art will realize that the LED illumination system may enhance its brightness and energy efficiency based on this self adjustment of VPWR.

Likewise, the clamping voltage VPWR may be adjusted to a lower level. In the second powering cycle (times t4-t6) in FIG. 6, the voltage VC does not reach VPWR. VPWR is reduced by the voltage Δvpwr2 when the cycle is terminated (time t5). In a preferred embodiment, the voltage Δvpwr2 is normally larger than Δvpwr1 such that VPWR is more sensitive to an insufficient clamping case. Both Δvpwr1 and Δvpwr2 are controlled at a low level, and VPWR variations are noted on an expanded time diagram in FIG. 5.

Figure 6:
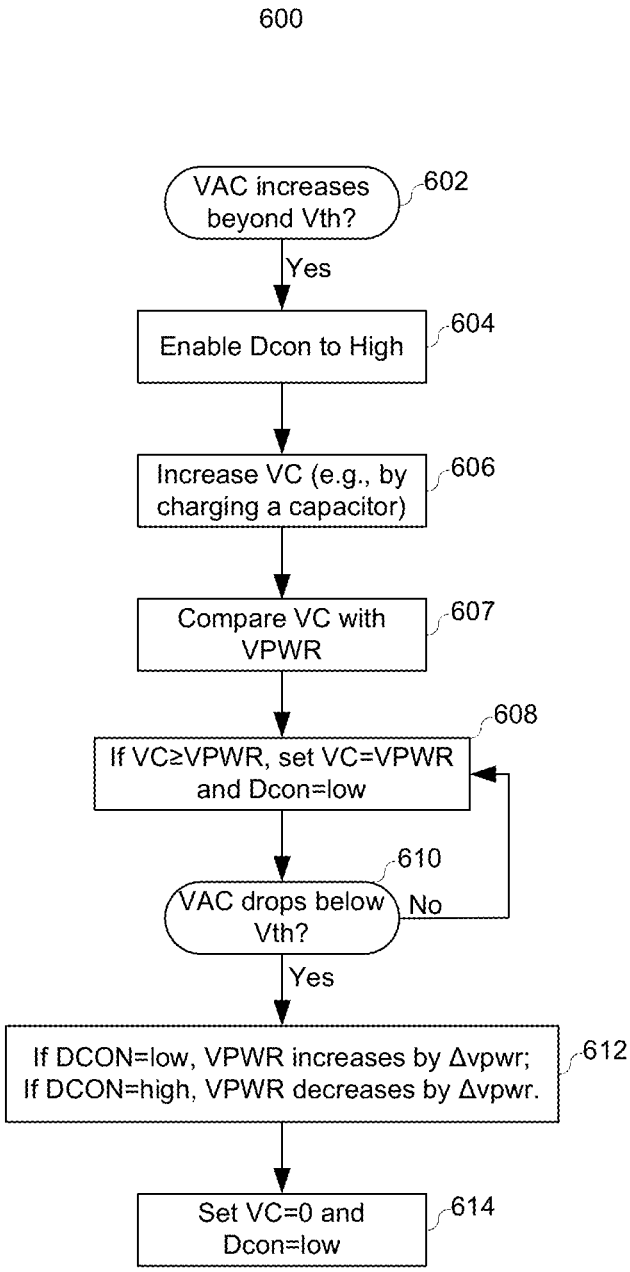
FIG. 6 illustrates an exemplary method of employing a feedback to adjust brightness and suppress flickers in a powering cycle according to various embodiments of the invention.

FIG. 6 illustrates an exemplary method 600 of employing a feedback to adjust brightness and suppress flickers in a powering cycle of a LED illumination system according to various embodiments of the invention. At the beginning of a powering cycle, the voltage VC and the driver control signal DCON are reset at ground, and the clamping voltage VPWR is adapted from a prior powering cycle. When a powering cycle starts with VAC increasing beyond a low threshold voltage Vth at step 602, the driver control signal DCON is enabled to high at step 604, and the voltage VC starts to be charged up at step 606. The voltage VC is compared with the clamping voltage VPWR at step 607. When the voltage VC reaches the clamping voltage VPWR, the driver control signal DCON is disabled to low, and the voltage VC remains at VPWR at step 608. At step 610, the powering cycle ends with VAC dropping below the low threshold voltage Vth. However, the voltage VC may not reach the clamping voltage VPWR when the powering cycle ends (step 610), and the driver control signal DCON remains high at step 610.

Subsequent to step 610, if the driver control signal DCON is low, the clamping voltage VPWR is adjusted up by a first voltage Δvpwr1, and if the driver control signal DCON is high, the clamping voltage VPWR is adjusted down by a second voltage Δvpwr2. In various embodiments of the present invention, the voltages Δvpwr1 and Δvpwr2 may be equal. However, in a preferred embodiment, Δvpwr2 is larger than Δvpwr1. At step 614, the voltage VC is reset to zero, and so does the driver control signal DCON if DCON is at a high level.

One of those skilled in the art will recognize that according to the above adjustment method, the LED illumination system may start up at a clamping voltage VPWR set to a random level, and VPWR may subsequently settle around a desirable level. In one embodiment, the initial level of VPWR is at ground. During the first few powering cycles, VPWR continuously increases by the voltage Δvpwr1 at the end of each cycle. Within a few seconds, VPWR will settle around a voltage level by the end of each powering cycle, and this voltage level of VPWR is associated with the LED brightness. As a result, human eyes witness a gradual lighting up process of the LED light without flickering or blinking.

It will be appreciated to those skilled in the art that the preceding examples and embodiments are exemplary and are for the purposes of clarity and understanding and not limiting to the scope of the present invention. It is intended that all permutations, enhancements, equivalents, combinations, and improvements thereto that are apparent to those skilled in the art upon a reading of the specification and a study of the drawings are included within the true spirit and scope of the present invention. It is, therefore, intended that the claims in the future non-provisional application will include all such modifications, permutation and equivalents as fall within the true spirit and scope of the present invention.

I claim:

1. A light-emitting diode (LED) driver control loop that drives a LED light, comprising:

a LED driver, coupled to the LED light, the LED driver receiving a switched mode supply and generating a LED current to drive the LED light according to a driver control, the switched mode supply being a pulsed voltage that comprises a plurality of powering cycles and including a dead band between every two consecutive powering cycles;

a charge integrator, coupled to the LED driver and the LED light, the charge integrator generating a charging voltage that increases at a rate associated with the LED current during each powering cycle;

a driver controller, coupled to the charge integrator, the driver controller disabling the driver control when the charging voltage reaches a clamping voltage during each powering cycle and resetting the driver control at the end of each powering cycle; and a voltage modulator, coupled to the driver controller, the voltage modulator adjusting the level of the clamping voltage according to the driver control at the end of each powering cycle.

2. The LED driver control loop in claim 1, wherein with each of the plurality of powering cycles, the level of the clamping voltage is adjusted by (1) an increase of a first variation, when the charging voltage reaches the clamping voltage before the powering cycle terminates and the driver control is low at the end of the powering cycle; and (2) a decrease of a second variation, when the charging voltage never reaches the clamping voltage during the powering cycle and the driver control is reset at the end of the powering cycle.

3. The LED driver control loop in claim 2, wherein both the first and second variations are associated with brightness variations of the LED light that are indiscernible to human eyes.

4. The LED driver control loop in claim 2, the second variation is substantially larger than the first variation.

5. The LED driver control loop in claim 2, the second variation is substantially equal to the first variation.

6. The LED driver control loop in claim 1, wherein the LED driver is selected from a group consisting of a boost regulator and a buck/boost regulator.

7. The LED driver control loop in claim 1, wherein the LED light is arranged in series with a resistor, and the charge integrator is associated with the LED current by monitoring a bias voltage across the resistor.

8. The LED driver control loop in claim 7, wherein the charge integrator generates an integration current that is proportional to the bias voltage across the resistor.

9. The LED driver control loop in claim 1, wherein the LED driver adjusts the LED current by modulating the width of the dead band in the switched mode supply according to the driver control.

10. The LED driver control loop in claim 1, wherein the frequency of the plurality of powering cycles is substantially 120 Hz.

11. A method of smoothly adjusting LED light brightness, comprising the steps of:

enabling a driver control at a beginning of each of a plurality of powering cycles;

generating a LED current from a switched mode supply to drive a LED light, the LED current being adjusted according to the driver control, the switched mode supply being a pulsed voltage associated with a dead band between every two consecutive powering cycles;

generating a charging voltage using a charge integrator during each powering cycle, the charging voltage increasing at a rate that is associated with the LED current;

disabling the driver control when the charging voltage reaches a clamping voltage during each powering cycle; and adjusting the level of the clamping voltage according to the driver control at the end of each powering cycle.

12. The method in claim 11, wherein with each of the plurality of powering cycles, wherein with each of the plurality of powering cycles, the level of the clamping voltage is adjusted by (1) an increase of a first variation, when the charging voltage reaches the clamping voltage before the powering cycle terminates and the driver control is low at the end of the powering cycle; and (2) a decrease of a second variation, when the charging voltage never reaches the clamping voltage during the powering cycle and the driver control is reset at the end of the powering cycle.

13. The method in claim 12, wherein both the first and second variations are associated with brightness variations of the LED light that are indiscernible to human eyes.

14. The method in claim 12, the second variation is substantially larger than the first variation.

15. The method in claim 12, the second variation is substantially equal to the first variation.

16. The method in claim 11, wherein the LED light is arranged in series with a resistor, and the charge integrator is associated with the LED current by monitoring a bias voltage across the resistor.

17. The method in claim 11, wherein the LED current is adjusted by modulating the width of the dead band in the switched mode supply according to the driver control.

18. The method in claim 11, wherein the frequency of the plurality of powering cycles is substantially 120 Hz.

19. A method of smoothly adjusting LED light brightness, comprising the steps of:

enabling a driver control at a beginning of each of a plurality of powering cycles;

generating a LED current from a switched mode supply to drive a LED light, the LED current being adjusted according to the driver control, the switched mode supply being a pulsed voltage associated with a dead band between every two consecutive powering cycles;

generating a charging voltage using a charge integrator during each powering cycle, the charging voltage increasing at a rate that is associated with the LED current;

disabling the driver control when the charging voltage reaches a clamping voltage during each powering cycle; and adjusting the level of the clamping voltage according to the driver control at the end of each powering cycle by (1) an increase of a first variation when the charging voltage reaches a clamping voltage before the powering cycle terminates, and (2) a decrease of a second variation when the charging voltage never reaches the clamping voltage during the powering cycle.

20. The method in claim 19, wherein both the first and second variations are associated with brightness variations of the LED light that are indiscernible to human eyes.

* * * * *